US006982672B2

(12) United States Patent
Lin et al.

(10) Patent No.: US 6,982,672 B2
(45) Date of Patent: Jan. 3, 2006

(54) MULTI-BAND ANTENNA AND SYSTEM FOR WIRELESS LOCAL AREA NETWORK COMMUNICATIONS

(75) Inventors: Shengli Lin, Shanghai (CN); Chunfei Ye, Shanghai (CN); Nilesh N. Shah, Rancho Cordova, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/795,781

(22) Filed: Mar. 8, 2004

(65) Prior Publication Data

US 2005/0195110 A1 Sep. 8, 2005

(51) Int. Cl.
*H01Q 1/38* (2006.01)

(52) U.S. Cl. ..... 343/700 MS; 343/846

(58) Field of Classification Search ..... 343/700 MS, 343/702, 846, 848, 853, 770
See application file for complete search history.

(56) References Cited

U.S. PATENT DOCUMENTS

| | | | | |
|---|---|---|---|---|
| 4,827,271 | A | 5/1989 | Berneking, W. D., et al. | 343/700 |
| 5,124,733 | A | 6/1992 | Haneishi, M. | 343/700 |
| 5,382,959 | A * | 1/1995 | Pett et al. | 343/700 MS |
| 6,181,281 | B1 | 1/2001 | Desclos, L., et al. | 343/700 |
| 6,320,547 | B1 * | 11/2001 | Fathy et al. | 343/700 MS |
| 6,556,169 | B1 * | 4/2003 | Fukuura et al. | 343/700 MS |
| 6,856,300 | B2 * | 2/2005 | McCarrick | 343/853 |
| 2002/0000937 | A1 * | 1/2002 | Kozakai | 343/700 MS |
| 2004/0155823 | A1 | 8/2004 | Kossiavas, G., et al. | 343/702 |

FOREIGN PATENT DOCUMENTS

| | | |
|---|---|---|
| EP | 0886336 A2 | 12/1998 |
| WO | WO-03/034545 A1 | 4/2003 |

OTHER PUBLICATIONS

"International Search Report for corresponding PCT Application PCT/US2005/007088", (Attorney Docket No. 884.C60WO1), (Jun. 22, 2005), 4 pgs.

* cited by examiner

*Primary Examiner*—Hoang V. Nguyen
(74) *Attorney, Agent, or Firm*—Schwegman, Lundberg, Woessner & Kluth, P.A.

(57) ABSTRACT

A multi-band antenna comprises a first conductive layer having one or more parasitic patches, a second conductive layer having a plurality of radiating patches, and a third conductive layer having a ground patch. The first, second and third conductive layers may be separated by first and second substrate layers. The second conductive layer may comprise a first radiating patch having dimensions selected to radiate signals within a first frequency spectrum and second radiating patches having dimensions selected to radiate signals within a second frequency spectrum. In wireless local area network (WLAN) embodiments, the first frequency spectrum may comprise a frequency band ranging from approximately 5.1 to 5.9 GHz, and the second frequency spectrum may comprise frequency bands ranging from approximately 2.4 to 2.5 GHz.

31 Claims, 2 Drawing Sheets

MULTI-BAND ANTENNA AND SYSTEM FOR WIRELESS LOCAL AREA NETWORK COMMUNICATIONS

TECHNICAL FIELD

Embodiments of the present invention pertain to antennas, and in some embodiments, to wireless local area networks.

BACKGROUND

Communication stations for wireless local area networks (WLANs) may communicate in different frequency bands depending on, for example, the region they are to be used in. For example, in the United States, a communication station may communicate in one or more certain frequency bands, while in Europe; a communication station may communicate in certain different frequency bands. In other regions, communication stations may communicate in yet different frequency bands. Conventionally, multiple antennas are provided for these different regions. These multi-antenna approaches are costly and require interface circuitry. Thus there are general needs for multi-band antenna suitable for use in WLANs operable more than one region and/or more than one frequency band.

BRIEF DESCRIPTION OF THE DRAWINGS

The appended claims are directed to some of the various embodiments of the present invention. However, the detailed description presents a more complete understanding of embodiments of the present invention when considered in connection with the figures, wherein like reference numbers refer to similar items throughout the figures and:

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of embodiments of the invention encompasses the full ambit of the claims and all available equivalents of those claims. Such embodiments of the invention may be referred to, individually or collectively, herein by the term "invention" merely for convenience and without intending to voluntarily limit the scope of this application to any single invention or inventive concept if more than one is in fact disclosed.

Figure 1A:
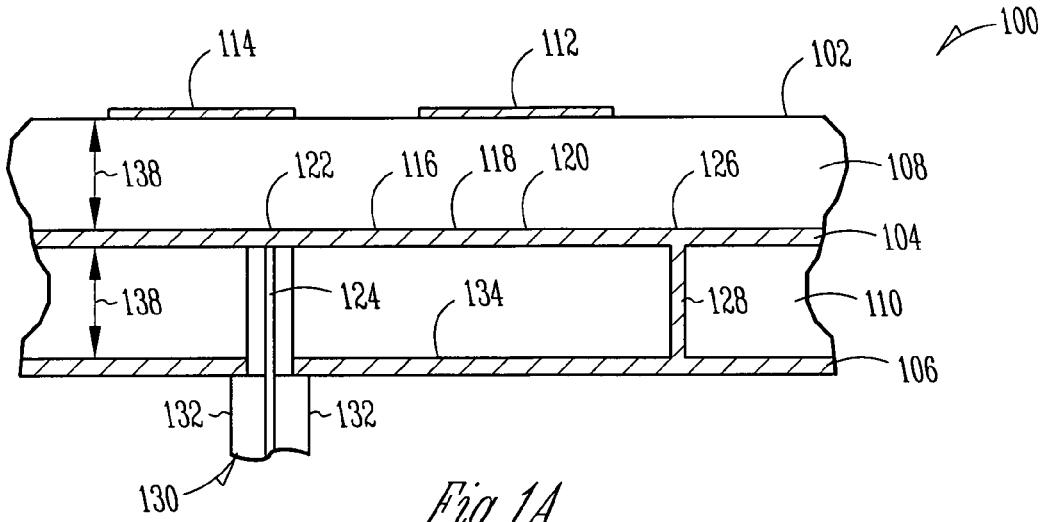
FIG. 1A illustrates a cross-sectional view of an antenna in accordance with some embodiments of the present invention.
Figure 1B:
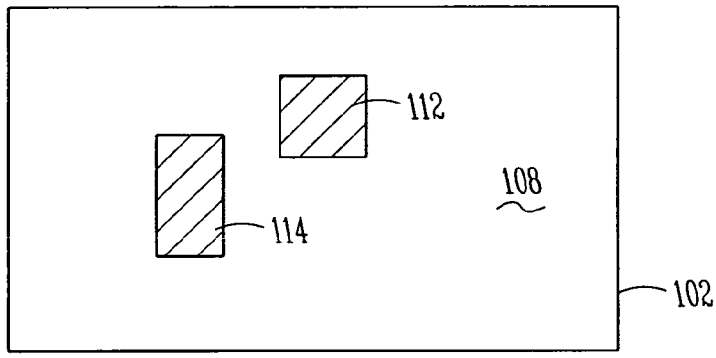
FIG. 1B illustrates a first conductive layer of an antenna in accordance with some embodiments of the present invention.
Figure 1C:
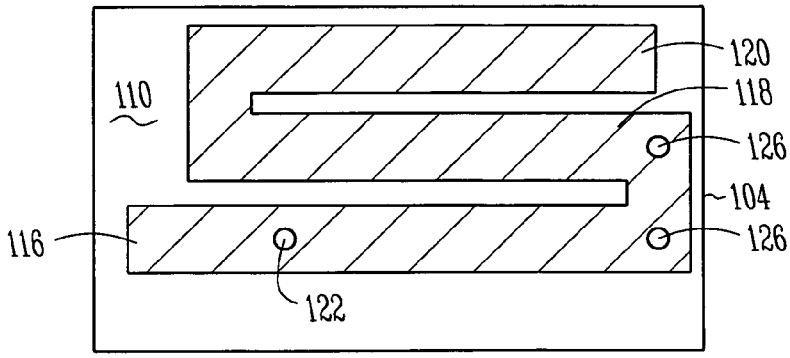
FIG. 1C illustrates a second conductive layer of an antenna in accordance with some embodiments of the present invention.
Figure 1D:
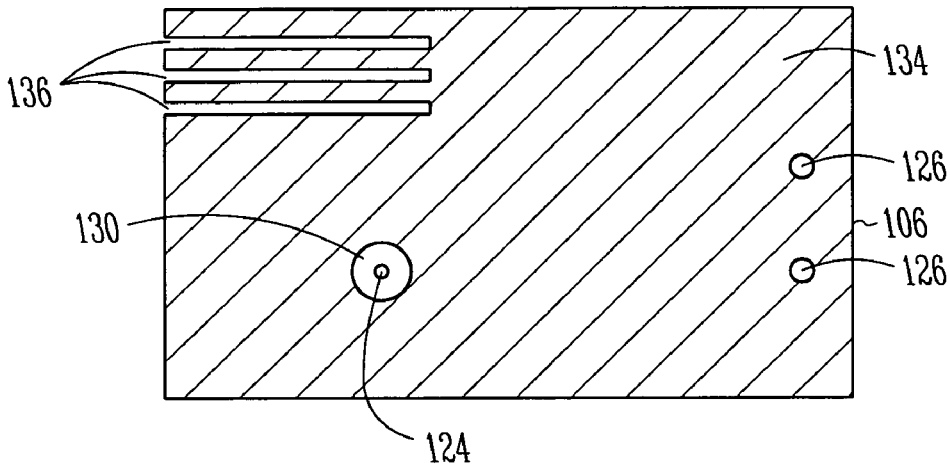
FIG. 1D illustrates a third conductive layer of an antenna in accordance with some embodiments of the present invention.

FIG. 1A illustrates a cross-sectional view of antenna 100 in accordance with some embodiments of the present invention. FIG. 1B illustrates a first conductive layer of antenna 100 in accordance with some embodiments of the present invention. FIG. 1C illustrates a second conductive layer of antenna 100 in accordance with some embodiments of the present invention. FIG. 1D illustrates a third conductive layer of antenna 100 in accordance with some embodiments of the present invention. Antenna 100 includes first conductive layer 102 comprising one or more parasitic patches 112 and 114, second conductive layer 104 comprising a plurality of radiating patches 116, 118 and 120, and third conductive layer 106 comprising ground patch 134. The first and second conductive layers may be separated by first substrate layer 108, and the second and third conductive layers may be separated by substrate layer 110. In some embodiments, second conductive layer 104 may include first radiating patch 116 and second radiating patches 118, 120.

First radiating patch 116 may have dimensions selected to radiate radio-frequency (RF) signals within a first frequency spectrum. Second radiating patches 118, 120 may have dimensions selected to radiate RF signals within a second frequency spectrum. In some embodiments, the first frequency spectrum may be a 5 GHz frequency spectrum and the second frequency spectrum may be a 2.4 GHz frequency spectrum. In some embodiments, the 2.4 GHz spectrum may include a frequency band ranging from approximately 2.4 to 2.5 GHz, and the 5 GHz frequency spectrum may include three frequency bands between approximately 5.1 to 5.9 GHz, although the scope of the invention is not limited in this respect.

Parasitic patches 112 and 114 may be electrically isolated from second conductive layer 104 and third conductive layers 106. During operation of antenna 100, parasitic patches 112 and 114 may couple energy radiated either to or from radiating patches 116, 118 and 120.

In some embodiments, radiating patches 116, 118 and 120 may be electrically coupled together and may have single feeding point 122 electrically coupling radiating patches 116, 118 and 120 to feed conductor 124. Feed conductor 124 may be almost any type of conductor including a wire or coaxial cable center conductor. Feed conductor 124 may be provided through second substrate layer 110 and through third conductive layer 106 as illustrated in FIG. 1A.

In some embodiments, radiating patches 116, 118 and 120 may have one or more grounding points 126 electrically coupling radiating patches 116, 118 and 120 to third conductive layer 106 by one or more conductive paths 128 provided through second substrate layer 110. Conductive paths 128 may comprise plated thru-vias or pins, although the scope of the invention is not limited in this respect. In some embodiments, feeding point 122 may be located at a first location on one of radiating patches 116, 118 and 120, and grounding points 126 may be located at second locations on one or more of radiating patches 116, 118 and 120.

In some embodiments, a center conductor of coaxial cable 130 may serve as feed conductor 124 and may be coupled to feeding point 122. In these embodiments, outer conductor 132 of coaxial cable 130 may be coupled to third conductive layer 106. In some embodiments, feed conductor 124 may be coupled to a wireless network communication station to receive radio frequency RF signals in at least one frequency spectrum from the antenna 100. In these embodiments, feed conductor 124 may also provide RF signals in the frequency spectrums to antenna 100 for transmission.

In some embodiments, third conductive layer 106 may substantially comprise ground patch 134. In other words, ground patch 134 may comprise most or all of third conductive layer 106, although the scope of the present invention is not limited in this respect. In some embodiments, third conductive layer 106 may comprise one or more slots 136 within the conductive material of ground patch 134.

In some embodiments, substrate layers 108 and 110 may comprise an organic substrate material. In other embodiments, substrate layers 108 and 110 may comprise an inorganic substrate material. Suitable organic substrate materials may include polytetrafluoroethylene (PTFE) composite laminates; however other organic substrate materials including flexible and rigid organic materials including laminate materials such as FR4 and FR5, and resins, such as Bismaleimide Triazine (BT) may be suitable. Suitable inorganic substrate materials include ceramic materials. In some embodiments, substrate layers 108 and 110 may comprise a material such as polyethylene, although the scope of the invention is not limited in this respect.

In some embodiments, substrate layers 108 and 110 may have a dielectric constant (Er) ranging from 1 to 4; however this is not a requirement. In some embodiments, substrate layers 108 and 110 may have a dielectric constant of approximately 2.3, although the scope of the invention is not limited in this respect. In some embodiments, substrate layers 108 and 110 may have a loss tangent (D) of approximately 0.01, although the scope of the invention is not limited in this respect. In some embodiments, substrate layers 108 and 110 may have thicknesses 138 ranging from 4 mm to 6 mm, although other thicknesses for substrate layers 108 and 110 may also be suitable.

In some embodiments, the 2.4 GHz frequency spectrum comprises a first frequency band ranging from approximately 2.4 to 2.5 GHz. In some embodiments, the 5 GHz frequency spectrum comprises a second frequency band ranging from approximately 5.15–5.35, a third frequency band ranging from approximately 5.47–5.725, and a fourth frequency band ranging from approximately 5.727–5.875, although the scope of the present invention is not limited in these respects. In these embodiments, antenna 100 may be referred to as a multi-band or quad-band antenna.

In some embodiments, parasitic patch 114 may have dimensions of approximately 3 mm×3.5 mm, and parasitic patch 112 may have dimensions of approximately 1 mm×2 mm, although the scope of the present invention is not limited in this respect. In some embodiments, radiating patch 116 may be substantially rectangular and may have dimensions of approximately 3.5 mm×12 mm, and radiating patches 118 and 120 may be substantially rectangular and may have dimensions of approximately 3.5 mm×12 mm, although the scope of the present invention is not limited in this respect. In some embodiments, ground patch 134 may have dimensions of approximately 24 mm×30 mm, although the scope of the present invention is not limited in these respects. Although in some embodiments, radiating patches 116, 118 and 120 may each have approximately the same dimensions, radiating patches 118 and 120 may together operate to radiate signals in a lower frequency spectrum, such as the second frequency spectrum.

In some embodiments, parasitic patches 112 and 114, radiating patches 116, 118 and 120 and ground patch 134 may comprise a conductive material such as gold, copper, tungsten, silver, brass, aluminum or steel, including alloys thereof, although the scope of the present invention is not limited in this respect. Other conductive materials may also be suitable.

The performance of antenna 100 may be based on the dielectric constant of substrate layers 108 and 110 and the thickness of substrate layers 108 and 110. The performance of antenna 100 may further be based on the location of feeding point 122, the locations of grounding points 126 and the number of grounding points 126. The performance of antenna 100 may further be based on the number of parasitic patches 112 and 114 on layer 102 and the size and location of the parasitic patches. The performance of antenna 100 may further be based on the length and width of radiating patches 116, 118 and 120 as well as the distance between radiating patches 116, 118 and 120. The performance of antenna 100 may further be based on the size of ground patch 134, the number of slots 136, the position of slots 136, and the length and width of slots 136. Other factors may also influence the performance of antenna 100. By properly choosing these antenna parameters, those of ordinary skill in the art may achieve, for example, a reflection coefficient at feeding point 122 of greater than −10 dB in the first, second, third and fourth frequency bands, although the scope of the present invention is not limited in this respect. By properly choosing these antenna parameters, acceptable antenna gain may also be achieved at least in the first, second, third and fourth frequency bands, although the scope of the present invention is not limited in this respect.

Although embodiments of the present invention are illustrated with two parasitic patches, this is not a requirement. Other numbers of parasitic patches may be used. The actual number of parasitic patches may be determined by trial and error.

In some embodiments, conventional printed layer circuit board (PCB) techniques may be used to manufacture antenna 100, although the scope of the invention is not limited in this respect. In some embodiments, the dimensions of the patches may be precisely manufactured using techniques, such as photolithography, although the scope of the invention is not limited in this respect.

In some embodiments, the plurality of radiating patches on second conductive layer 104 may cumulatively define the frequency spectrums of operation.

In some embodiments, antenna 100 may be a multi-layer, multi-band antenna. In these embodiments, antenna 100 comprises first conductive layer 102 comprising one or more parasitic patches 112 and 114, second conductive layer 104 comprising a plurality of radiating patches 116, 118 and 120, and third conductive layer 106 comprising ground patch 134. First substrate layer 108 separates first and second conductive layers 102 and 104 and second substrate layer 110 separates second and third conductive layers 104 and 106. Parasitic patches 112 and 114 may be electrically isolated from the second and third conductive layers, and radiating patches 116, 118 and 120 may be electrically coupled and may have single feeding point 122 to electrically couple radiating patches 116, 118 and 120 to feed conductor 124.

In some embodiments, a multi-layer circuit board is provided. In these embodiments, the multi-layer circuit board may provide one or more antennas, such as one or more of antenna 100. In these embodiments, the multi-layer circuit board may comprise, for each of the one or more antennas, one or more parasitic patches 112 and 114 disposed on first substrate layer 108, a plurality of radiating patches 116, 118 and 120 disposed on second substrate layer 110, and ground patch 134 disposed on second substrate layer 110 on a side opposite radiating patches 116, 118 and 120. In these embodiments, for each of the one or more antennas, a center conductor of a coaxial cable may be coupled to a feeding point and an outer conductor of the coaxial cable may be coupled to the ground patch.

In some embodiments, antenna 100 may be a first multi-band antenna of the multi-layer circuit board. In these embodiments, the circuit board may further comprise a second multi-band antenna which may comprise a second one or more parasitic patches disposed on the first substrate layer, a second plurality of radiating patches disposed on the second substrate layer, and a second ground patch disposed on the second substrate layer on the side opposite the second radiating patches. In some embodiments, the ground patches may be shared among the antennas of the circuit board.

Figure 2:
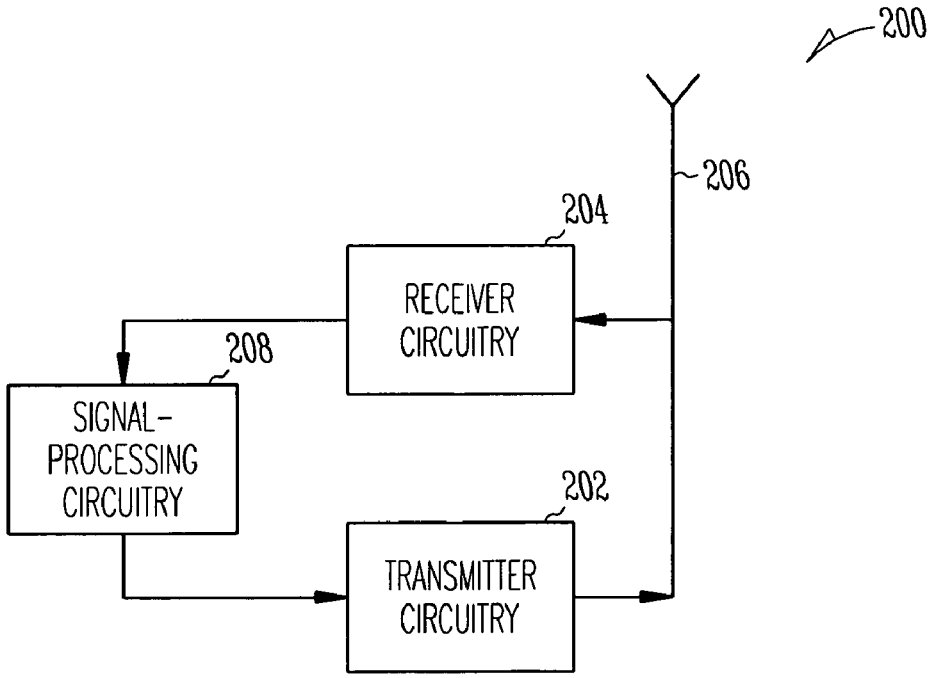
FIG. 2 illustrates a block diagram of a communication station in accordance with some embodiments of the present invention.

FIG. 2 is a block diagram of a communication station in accordance with some embodiments of the present invention. Communication station 200 may be a wireless communication device and may transmit and/or receive wireless communications signals with transmitter circuitry 202 and/or receiver circuitry 204 using one or more antennas 206. Antenna 100 (FIGS. 1A through 1D) is an example of an antenna that may be suitable for use as one or more of antennas 206.

Signal processing circuitry 208 may process digital signals provided by receiver circuitry 204. Signal processing circuitry 208 may also provide digital signals to transmitter circuitry 202 for transmission by one or more of antennas 206. In some embodiments, receiver circuitry 204 and transmitter circuitry 202 may be cumulatively referred to as transceiver circuitry.

In some embodiments, communication station 200 may be referred to as a receiving station, and in some embodiments, communication station 200 may be referred to as a transmitting station. In some embodiments, communication station may communicate orthogonal frequency division multiplexed (e.g., OFDM) communication signals with one or more other communication stations as described in more detail below.

In some embodiments, communication station 200 may communicate with one or more other communication stations over an OFDM communication channel. In some embodiments, the OFDM communication channel may comprise either a standard-throughput channel or a high-throughput communication channel. In these embodiments, the standard-throughput channel may comprise one subchannel and the high-throughput channel may comprise a combination of one or more subchannels and one or more spatial channels associated with each subchannel. Spatial channels may be non-orthogonal channels associated with a particular subchannel.

The subchannels may be frequency-division multiplexed (i.e., separated in frequency with other subchannels) and may be within a predetermined frequency spectrum. The subchannels may comprise a plurality of orthogonal subcarriers. In some embodiments, the orthogonal subcarriers of a subchannel may be closely spaced OFDM subcarriers. To achieve orthogonality between closely spaced subcarriers, in some embodiments, the subcarriers of a particular subchannel may have null at substantially a center frequency of the other subcarriers of that subchannel.

In some embodiments, a high-throughput communication channel may comprise a wideband channel having up to four frequency separated subchannels, a multiple-input-multiple-output (MIMO) channel comprising a single subchannel having up to four spatial channels, or a wideband-MIMO channel comprising two or more frequency separated subchannels where each subchannel has two or more spatial channels. In these embodiments, a wideband channel may have a wideband channel bandwidth of up to 80 MHz and may comprise up to four of the subchannels, although the scope of the invention is not limited in this respect. The subchannels may have a subchannel bandwidth of approximately 20 MHz, although the scope of the invention is not limited in this respect.

In some embodiments, communication station 200 may comprise more than one of antennas 206 to communicate over more than one spatial channel within a subchannel and/or more than one subchannel. In these embodiments, the OFDM communication channel may be a high-throughput communication channel.

In some embodiments, the frequency spectrums for an OFDM communication channel may comprise subchannels in either a 5 GHz frequency spectrum or a 2.4 GHz frequency spectrum. In these embodiments, the 5 GHz frequency spectrum may include frequency bands from approximately 4.9 to 5.9 GHz, and the 2.4 GHz spectrum may include a frequency band ranging from approximately 2.4 to 2.5 GHz, although the scope of the invention is not limited in this respect, as other frequency spectrums may be equally suitable.

In some embodiments, communication station 200 may be a personal digital assistant (PDA), a laptop or portable computer with wireless-networking communication capability, a web tablet, a wireless telephone, a wireless headset, a pager, an instant messaging device, a digital camera, an access point or other device that may receive and/or transmit information wirelessly. In some embodiments, communication station 200 may transmit and/or receive radio-frequency (RF) communications in accordance with specific communication standards, such as the Institute of Electrical and Electronics Engineers (EEE) standards including EEE 802.11(a), 802.11(b), 802.11(g/h), and/or 802.11 (n) standards for wireless local area networks. In other embodiments, communication station 200 may transmit and/or receive communications in accordance with other techniques including the Digital Video Broadcasting Terrestrial (DVB-T) broadcasting standard, and the High performance radio Local Area Network (HiperLAN) standard.

Although communication station 200 is illustrated as having several separate functional elements, one or more of the functional elements may be combined and may be implemented by combinations of software-configured elements, such as processing elements including digital signal processors (DSPs), and/or other hardware elements. For example, the circuitry illustrated may comprise processing elements which may comprise one or more microprocessors, DSPs, application specific integrated circuits (ASICs), and combinations of various hardware and logic circuitry for performing at least the functions described herein.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention lies in less than all features of a single disclosed embodiment. Thus the following claims are hereby incorporated into the detailed description, with each claim standing on its own as a separate preferred embodiment.

What is claimed is:

1. An antenna comprising:

a first conductive layer comprising one or more parasitic patches;

a second conductive layer comprising a plurality of radiating patches; and a third conductive layer comprising a ground patch, wherein the first, second and third conductive layers are separated by first and second substrate layers, and wherein at least one grounding point electrically couples at least one of the radiating patches to the third conductive layer by a conductive path provided through the second substrate layer wherein the radiating patches having a single feed point.

2. The antenna of claim 1 wherein the one or more parasitic patches are electrically isolated from the second and third conductive layers, wherein during operation of the antenna, the one or more parasitic patches are to couple energy radiated either to or from the radiating patches.

3. The antenna of claim 1 wherein the plurality of radiating patches have more than one grounding points electrically coupling the radiating patches to the third conductive layer by a corresponding more than one conductive paths provided through the second substrate layer.

4. The antenna of claim 3 wherein the plurality of radiating patches are electrically coupled and have the single feeding point electrically coupling the radiating patches to a feed conductor provided through the second substrate layer and through the third conductive layer, and wherein the feeding point is located at a first location on the radiating patches and the more than one grounding points are located at second locations on the radiating patches.

5. The antenna of claim 4 wherein a center conductor of a coaxial cable is coupled to the feeding point and an outer conductor of the coaxial cable is coupled to the third conductive layer.

6. An antenna comprising:

a first conductive layer comprising one or more parasitic patches;

a second conductive layer comprising a plurality of radiating patches; and a third conductive layer comprising a ground patch, wherein the first, second and third conductive layers are separated by first and second substrate layers, wherein the second conductive layer comprises:

a first radiating patch having dimensions selected to radiate signals within a first frequency spectrum; and second radiating patches having dimensions selected to radiate signals within a second frequency spectrum.

7. The antenna of claim 6 wherein the first frequency spectrum is a 5 GHz frequency spectrum and the second frequency spectrum is a 2.4 GHz frequency spectrum, the 2.4 GHz spectrum comprising a frequency band ranging from approximately 2.4 to 2.5 GHz, the 5 GHz frequency spectrum comprising frequency bands from approximately 5.1 to 5.9 GHz.

8. The antenna of claim 7 wherein the 2.4 GHz frequency spectrum comprises a first frequency band ranging from approximately 2.4 to 2.5 GHz, and wherein the 5 GHz frequency spectrum comprises:

a second frequency band ranging from approximately 5.15–5.35;

a third frequency band ranging from approximately 5.47–5.725; and a fourth frequency band ranging from approximately 5.727–5.875.

9. The antenna of claim 8 wherein a first of the parasitic patches has dimensions of approximately 3 mm×3.5 mm, wherein a second of the parasitic patches has dimensions of approximately 1 mm×2 mm, wherein the first radiating patch is substantially rectangular and has dimensions of approximately 3.5 mm×12 mm, wherein the second radiating patches are substantially rectangular and have dimensions of approximately 3.5 mm×12 mm, and wherein the ground patch has dimensions of approximately 24 mm×30 mm and has one or more slots therein.

10. The antenna of claim 6 wherein the plurality of radiating patches are electrically coupled and have a single feeding point electrically coupling the radiating patches to a feed conductor provided through the second substrate layer and through the third conductive layer.

11. The antenna of claim 10 wherein the feed conductor is coupled to a wireless network communication station, wherein the feed conductor is to receive radio frequency (RF) signals in at least one of the frequency spectrums from the antenna, and wherein the feed conductor is to provide RF signals in the at least one of the frequency spectrums to the antenna for transmission.

12. An antenna comprising:

a first conductive layer comprising one or more parasitic patches;

a second conductive layer comprising a plurality of radiating patches; and a third conductive layer comprising a ground patch, wherein the first, second and third conductive layers are separated by first and second substrate layers, wherein the third conductive layer substantially comprises the ground patch, and wherein the third conductive layer comprises one or more tuning slots within the ground patch.

13. The antenna of claim 12 wherein the substrate layers comprise an organic substrate material.

14. The antenna of claim 12 wherein the substrate layers comprise an inorganic substrate material.

15. The antenna of claim 12 wherein the parasitic patches, the radiating patches and the ground patch are conductive and comprise at least one of gold, copper, tungsten, silver, brass, aluminum or steel, including alloys thereof.

16. A multi-layer, multi-band antenna comprising:

a first conductive layer comprising one or more parasitic patches;

a second conductive layer comprising a plurality of radiating patches;

a third conductive layer comprising a ground patch;

a first substrate layer separating the first and second conductive layers; and a second substrate layer separating the second and third conductive layers, wherein the one or more parasitic patches are electrically isolated from the second and third conductive layers, wherein the plurality of radiating patches are electrically coupled and have a single feeding point to electrically couple the radiating patches to a feed conductor, and wherein the plurality of radiating patches have one or more grounding points electrically coupling the radiating patches to the third conductive layer by a conductive path provided through the second substrate layer.

17. A multi-layer, multi-band antenna comprising:

a first conductive layer comprising one or more parasitic patches:

a second conductive layer comprising a plurality of radiating patches;

a third conductive layer comprising a ground patch;

a first substrate layer separating the first and second conductive layers; and a second substrate layer separating the second and third conductive layers, wherein the one or more parasitic patches are electrically isolated from the second and third conductive layers, wherein the plurality of radiating patches are electrically coupled and have a single feeding point to electrically couple the radiating patches to a feed conductor, wherein the plurality of radiating patches have one or more grounding points electrically coupling the radiating patches to the third conductive layer by a conductive path provided through the second substrate layer, and wherein the third conductive layer has one or more slots therein.

18. A multi-layer, multi-band antenna comprising:

a first conductive layer comprising one or more parasitic patches;

a second conductive layer comprising a plurality of radiating patches;

a third conductive layer comprising a ground patch;

a first substrate layer separating the first and second conductive layers; and a second substrate layer separating the second and third conductive layers, wherein the one or more parasitic patches are electrically isolated from the second and third conductive layers, wherein the plurality of radiating patches are electrically coupled and have a single feeding point to electrically couple the radiating patches to a feed conductor, wherein the second conductive layer comprises:

a first radiating patch having dimensions selected to radiate signals within a first frequency spectrum; and second radiating patches having dimensions selected to radiate signals within a second frequency spectrum, wherein a center conductor of a coaxial cable is coupled to the feeding point and an outer conductor of the coaxial cable is coupled to the third conductive layer, and wherein the third conductive layer substantially comprises the ground patch.

19. A multi-layer circuit board comprising:

one or more parasitic patches disposed on a first substrate layer;

a plurality of radiating patches disposed on a second substrate layer; and a ground patch disposed on the second substrate layer on a side opposite the radiating patches, wherein the one or more parasitic patches are electrically isolated from the radiating patches and the ground patch, wherein the plurality of radiating patches are electrically coupled and have a single feeding point to electrically couple the radiating patches to a feed conductor and wherein the plurality of radiating patches has one or more grounding points electrically coupling the radiating patches to the ground patch by a conductive path provided through the second substrate layer.

20. A multi-layer circuit board comprising:

one or more parasitic patches disposed on a first substrate layer;

a plurality of radiating patches disposed on a second substrate layer; and a ground patch disposed on the second substrate layer on a side opposite the radiating patches, wherein the one or more parasitic patches are electrically isolated from the radiating patches and the ground patch, wherein the plurality of radiating patches are electrically coupled and have a single feeding point to electrically couple the radiating patches to a feed conductor, wherein the one or more parasitic patches, the radiating patches and the ground patch comprises a multi-band antenna, wherein the plurality of radiating patches have one or more grounding points electrically coupling the radiating patches to the ground patch by a conductive path provided through the second substrate layer, and wherein the ground patch has one or more slots therein.

21. The circuit board of claim 20 wherein the plurality of radiating patches comprises:

a first radiating patch having dimensions selected to radiate signals within a first frequency spectrum; and second radiating patches having dimensions selected to radiate signals within a second frequency spectrum, and wherein a center conductor of a coaxial cable is coupled to the feeding point and an outer conductor of the coaxial cable is coupled to the ground patch.

22. The circuit board of claim 21 wherein the multi-band antenna is a first multi-band antenna, and wherein the circuit board further comprises a second multi-band antenna therein, the second multi-band antenna comprising:

second one or more parasitic patches disposed on the first substrate layer;

a second plurality of radiating patches disposed on the second substrate layer; and a second ground patch disposed on the second substrate layer on a side opposite the second radiating patches.

23. A system comprising:

a transceiver; and an antenna coupled to the transceiver, the antenna comprising:

a first conductive layer comprising one or more parasitic patches;

a second conductive layer comprising a plurality of radiating patches; and a third conductive layer comprising a ground patch, wherein the first, second and third conductive layers are separated by first and second substrate layers, and wherein the one or more parasitic patches are electrically isolated from the second and third conductive layers, wherein the plurality of radiating patches are electrically coupled and have a single feeding point to electrically couple the radiating patches to a feed conductor, wherein the plurality of radiating patches have one or more grounding points electrically coupling the radiating patches to the third conductive layer by a conductive path provided through the second substrate layer.

24. A system comprising:

a transceiver; and an antenna coupled to the transceiver, the antenna comprising:

a first conductive layer comprising one or more parasitic patches;

a second conductive layer comprising a plurality of radiating patches; and a third conductive layer comprising a ground patch, wherein the first, second and third conductive layers are separated by first and second substrate layers, wherein the one or more parasitic patches are electrically isolated from the second and third conductive layers, wherein the plurality of radiating patches are electrically coupled and have a single feeding point to electrically couple the radiating patches to a feed conductor, wherein the plurality of radiating patches have one or more grounding points electrically coupling the radiating patches to the third conductive layer by a conductive path provided through the second substrate layer, and wherein the third conductive layer comprises one or more slots therein.

25. The system of claim 24 wherein the second conductive layer comprises:

a first radiating patch having dimensions selected to radiate signals within a first frequency spectrum; and second radiating patches having dimensions selected to radiate signals within a second frequency spectrum, and wherein a center conductor of a coaxial cable is coupled to the feeding point and an outer conductor of the coaxial cable is coupled to the third conductive layer, and wherein the third conductive layer substantially comprises the ground patch.

26. A multi-antenna communication station comprising:

a transceiver to receive and transmit orthogonal frequency division multiplexed signals over a high-throughput communication channel; and a plurality of antennas, at least some of the antennas comprising:

a first conductive layer comprising one or more parasitic patches;

a second conductive layer comprising a plurality of radiating patches; and a third conductive layer comprising a ground patch, wherein the first, second and third conductive layers are separated respectively by first and second substrate layers, wherein the high-throughput communication channel comprises a combination of either one or more subchannels or one or more spatial channels associated with one or more subchannels, and wherein each of the at least some of the antennas is to communicate within one of the subchannels or within one of the spatial channels.

27. The communication station of claim 26 wherein for each antenna, the one or more parasitic patches are electrically isolated from the second and third conductive layers and the plurality of radiating patches are electrically coupled and have a single feeding point to electrically couple the radiating patches to a feed conductor, wherein for each of the antennas, the plurality of radiating patches have one or more grounding points electrically coupling the radiating patches to the third conductive layer by a conductive path provided through the second substrate layer, and wherein for each of the antennas, wherein the third conductive layer comprises one or more slots therein.

28. The communication station of claim 27 wherein the high-throughput communication channel comprises one of:

a wideband channel having up to four frequency separated subchannels wherein at least one antenna is associated with each subchannel;

a multiple-input-multiple-output (MIMO) channel comprising a single subchannel having up to four spatial channels wherein at least one antenna is associated with each spatial channel; and a wideband-MIMO channel comprising two or more frequency separated subchannels, each subchannel having two or more spatial channels wherein at least one antenna is associated with each subchannel-spatial channel combination.

29. The communication station of claim 28 wherein for each of the antennas, the second conductive layer comprises:

a first radiating patch having dimensions selected to radiate signals within a first frequency spectrum; and second radiating patches having dimensions selected to radiate signals within a second frequency spectrum, and wherein for each antenna, a center conductor of a coaxial cable is coupled to the feeding point and an outer conductor of the coaxial cable is coupled to the third conductive layer, and wherein for each of the antennas, the third conductive layer substantially comprises the ground patch.

30. The communication station of claim 29 wherein the wideband channel has a wideband channel bandwidth of up to 80 MHz and comprises up to four of the subchannels, wherein the subchannels are non-overlapping orthogonal frequency division multiplexed channels, wherein each subchannel has a subchannel bandwidth of approximately 20 MHz and comprises a plurality of orthogonal subcarriers, and wherein the one or more spatial channels are non-orthogonal channels associated with one of the subchannels.

31. The communication station of claim 26 wherein each subchannel comprises a plurality of orthogonal subcarriers, and wherein the subcarriers of an associated subchannel have a null at substantially a center frequency of the other subcarriers to achieve substantial orthogonality between the subcarriers of the associated subchannel.

* * * * *